US011585114B2

(12) United States Patent
Smith

(10) Patent No.: US 11,585,114 B2
(45) Date of Patent: Feb. 21, 2023

(54) FENCE RAIL FORK

(71) Applicant: Andrew Row Smith, Jessup, MD (US)

(72) Inventor: Andrew Row Smith, Jessup, MD (US)

( * ) Notice: Subject to any disclaimer, the term of this patent is extended or adjusted under 35 U.S.C. 154(b) by 207 days.

(21) Appl. No.: 17/218,012

(22) Filed: Mar. 30, 2021

(65) Prior Publication Data

US 2021/0301552 A1 Sep. 30, 2021

Related U.S. Application Data

(60) Provisional application No. 63/001,685, filed on Mar. 30, 2020.

(51) Int. Cl.

| | |
|---|---|
| ***E04H 17/26*** | (2006.01) |
| ***E04H 17/14*** | (2006.01) |
| ***E04H 17/20*** | (2006.01) |

(52) U.S. Cl.

CPC ..... *E04H 17/26* (2013.01); *E04H 17/1465* (2021.01); *E04H 17/143* (2013.01); *E04H 17/21* (2021.01)

(58) Field of Classification Search

CPC ..... E04H 17/1413; E04H 17/1447; E04H 17/1452; E04H 17/1456; E04H 17/1465; E04H 17/1469; E04H 17/1486; E04H 17/20; E04H 17/21; E04H 17/26

See application file for complete search history.

(56) References Cited

U.S. PATENT DOCUMENTS

| | | | | |
|---|---|---|---|---|
| 3,955,801 | A * | 5/1976 | Soriero, Jr. | E04H 17/1413 256/65.13 |
| 4,007,919 | A * | 2/1977 | Totten | E04H 17/1413 256/65.13 |
| 5,601,278 | A * | 2/1997 | Graber | E04H 17/143 256/66 |
| 8,407,872 | B2 * | 4/2013 | Powell | E04H 17/26 254/131.5 |
| 9,353,546 | B2 * | 5/2016 | Garza Montemayor | E04H 17/143 |
| 2011/0127482 | A1 * | 6/2011 | Lo | E04H 17/1417 256/68 |

FOREIGN PATENT DOCUMENTS

GB 1233304 A * 5/1971

* cited by examiner

*Primary Examiner* — Jonathan P Masinick

(74) *Attorney, Agent, or Firm* — White-Welker & Welker, LLC; Matthew T. Welker, Esq.

(57) ABSTRACT

A vinyl fence rail remover for use where the rail is held in the fence post via tabs cut into the rail and rail tabs must be depressed to remove the rail from the hole cut into the fence post. The fence remover has a handle/tube on a first end, a metal "U" shape section, a straight section, and a tapered second, opposing end from the handle/tube. The handle/tube is as long as necessary to reach the bottom rail through the inside of the fence post. The "U" shaped middle piece is ⅛ inch to ¼ inch smaller than the exact size of the fence rail. The open end of straight section extending from the "U" shaped section is tapered or bent outward to allow it to slip over the tabs of a fence rail as the device is driven over the rail inside the fence post.

17 Claims, 13 Drawing Sheets

FENCE RAIL FORK

FEDERALLY SPONSORED RESEARCH

Not Applicable

SEQUENCE LISTING OR PROGRAM

Not Applicable

TECHNICAL FIELD OF THE INVENTION

The present invention relates to fence repair and removal devices. More specifically, the present invention relates to a tool for the removal of vinyl fencing pieces.

BACKGROUND OF THE INVENTION

According to various industry estimates, the vinyl fencing industry is anticipated to exceed 1.6 billion USD by 2024. The industry has recognized that here been a shift in preference among the consumers towards sustainable and eco-friendly fencing solutions, propelling the demand for vinyl fencing.

Vinyl is expected to witness steady growth over the coming years. Vinyl has accounted for over 50% of the material used in U.S. plastic fencing market. Vinyl fencing has excellent durability, weather, and abrasion resistance coupled with cost-effectiveness has bolstered its demand in the region. Vinyl fencing also provides ease of application when compared to wood and metal fencing as it doesn't require painting or staining and is available in ready to install strips.

Repair or removal of vinyl fencing requires use of specialized tools to remove sections without damage to other sections of the fencing, which is typically comprised of both a plurality of horizontal sections top and bottom and pickets, located between opposing posts to retain the plurality of horizontal sections. As the amount of vinyl fencing increases, the need for removal and replacement will also drastically increase, necessitating the use of a specific tool, designed to make the job quicker and easier with a substantial reduction in damage to existing vinyl fence sections or parts when removing other sections or parts for repair or replacement.

The prior art does teach tools for fence rail removal, generally referring to them as fence rail retractors. Generally, the prior art teaches tools which approach the rail tab problem from outside the fence post. These tools are cumbersome to use and expensive to manufacture as they consist of two separate pieces and during operation, the method of removal requires them to be inserted on each side of the rail, which is impossible for most applications unless multiple workers are present and a large gap is present between the rail and the hole in the post.

Therefore, what is needed is a one-piece tool solution that is simple and inexpensive to manufacture and only requires one worker. The present invention teaches just such a solution, where the removal device is a one-piece tool which is inserted inside the fence post and requires one swift action by a single worker to push in the tabs on both sides of the rail.

Additionally, the solution taught by the present invention works no matter how tight the rail fits into the fence post, which is a common problem with prior art designs that require an existing gap in the fence rail construction in order to be useful without potentially causing undue damage to other parts of the fence or the worker when forcing them into position.

Definitions

Unless stated to the contrary, for the purposes of the present disclosure, the following terms shall have the following definitions:

For the purposes of the present application, any reference made to "vinyl" or "vinyl fencing" is intended to cover any synthetic or plastic fence made of vinyl or any PVC material.

A synthetic fence, plastic fence or (when made of vinyl) vinyl or PVC fence is a fence made using synthetic plastics, such as vinyl (PVC), polypropylene, nylon, polythene (polyethylene) ASA, or from various recycled plastics. Composites of two or more plastics can also be used to increase strength and UV stability of a fence. Synthetic fencing was first introduced to the agricultural industry in the 1980s as a low cost/durable solution for long lasting horse fencing. Now, synthetic fencing is used for agricultural fencing, horse racetrack running rail, and residential use. Synthetic fencing is generally available preformed, in a wide variety of styles. It tends to be easy to clean, resists weathering and has low maintenance requirements.

SUMMARY OF THE INVENTION

The present invention teaches a PVC or Vinyl fence rail remover where the rail is held in the fence post via tabs cut into the rail. The rail tabs must be depressed to remove the rail from the hole cut into the fence post. The fence remover has a metal "U" shape on one end of a tube. The tube can be as long as necessary to reach the bottom rail through the inside of the fence post, typically 3 foot and 6 foot. The "U" shaped piece is the exact size or ⅛ inch to ¼ inch smaller than the size of the fence rail, typically 1.5 to 2 inches wide. The open end of the "U" shaped metal is tapered or bent outward to allow it to slip over the tabs as the device is driven over the rail inside the fence post. The rail remover is operated by removing the fence post cap and pushing the fence rail remover over the top fence rail keeping the tabs centered in the "U" shaped piece. As the remover is pushed over the rail it pushes the tabs in. The top rail can then be pulled through the hole in the fence post with no damage to the tabs allowing it to be reused. The same procedure can be repeated for as many rails that are in the fence post.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

Figure 1:
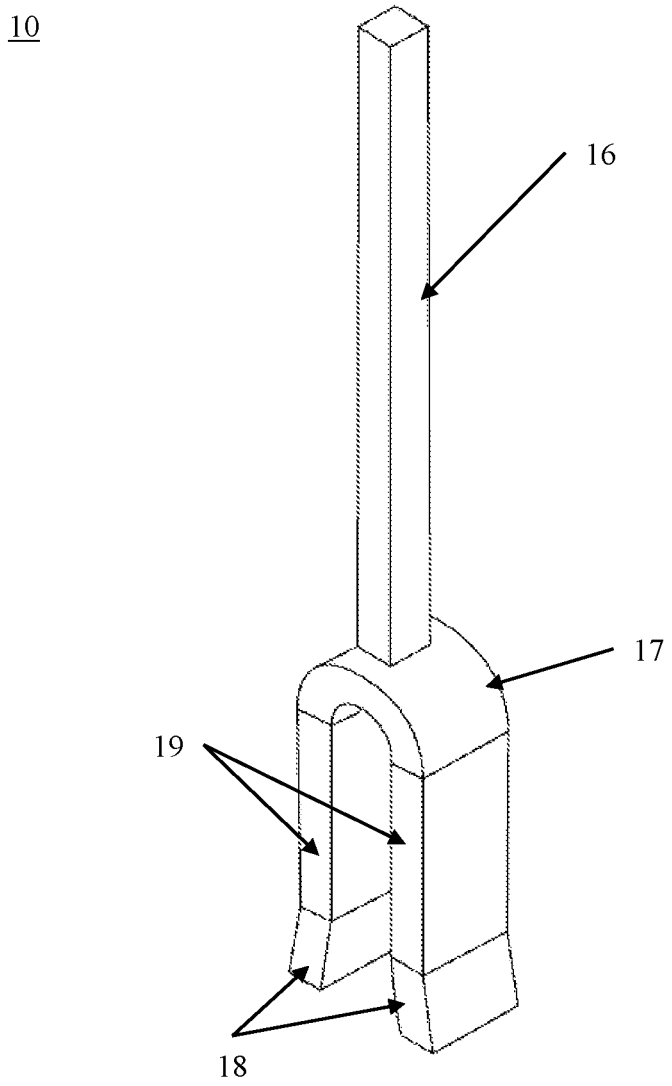
FIG. 1 is a side perspective view of the device of the present invention.

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized, and logical, mechanical, electrical, and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention.

The present invention is a fence rail removal tool 10 for the repair or removal of vinyl fencing that requires use of specialized tools to remove sections without damage to other sections of the fencing. The fence rail removal tool 10 of the present invention is typically applicable and necessary with vinyl fencing which is uniquely comprised of both a plurality of rail or horizontal sections 11 along the top, bottom, and middle; and a plurality of pickets 13, located between opposing posts 12 to retain the plurality of horizontal sections 11 where the rail or horizontal sections 11 is held in the fence post 12 via tabs 14 cut into the rail or horizontal sections 11.

Figure 10:
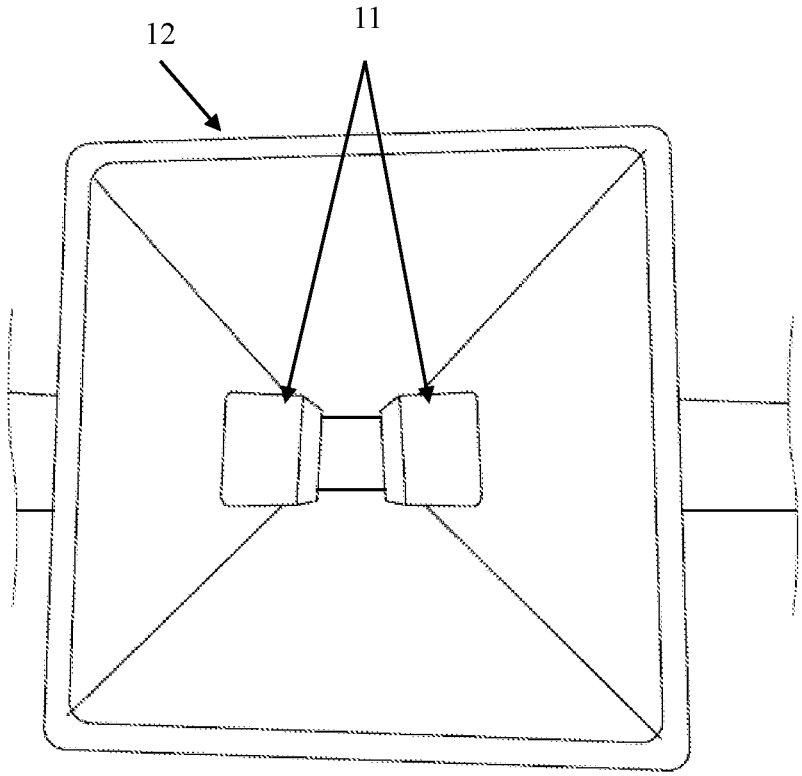
FIGS. 10-11 are photos of illustrative vinyl fences and the connection means of the posts and rails.
Figure 11:
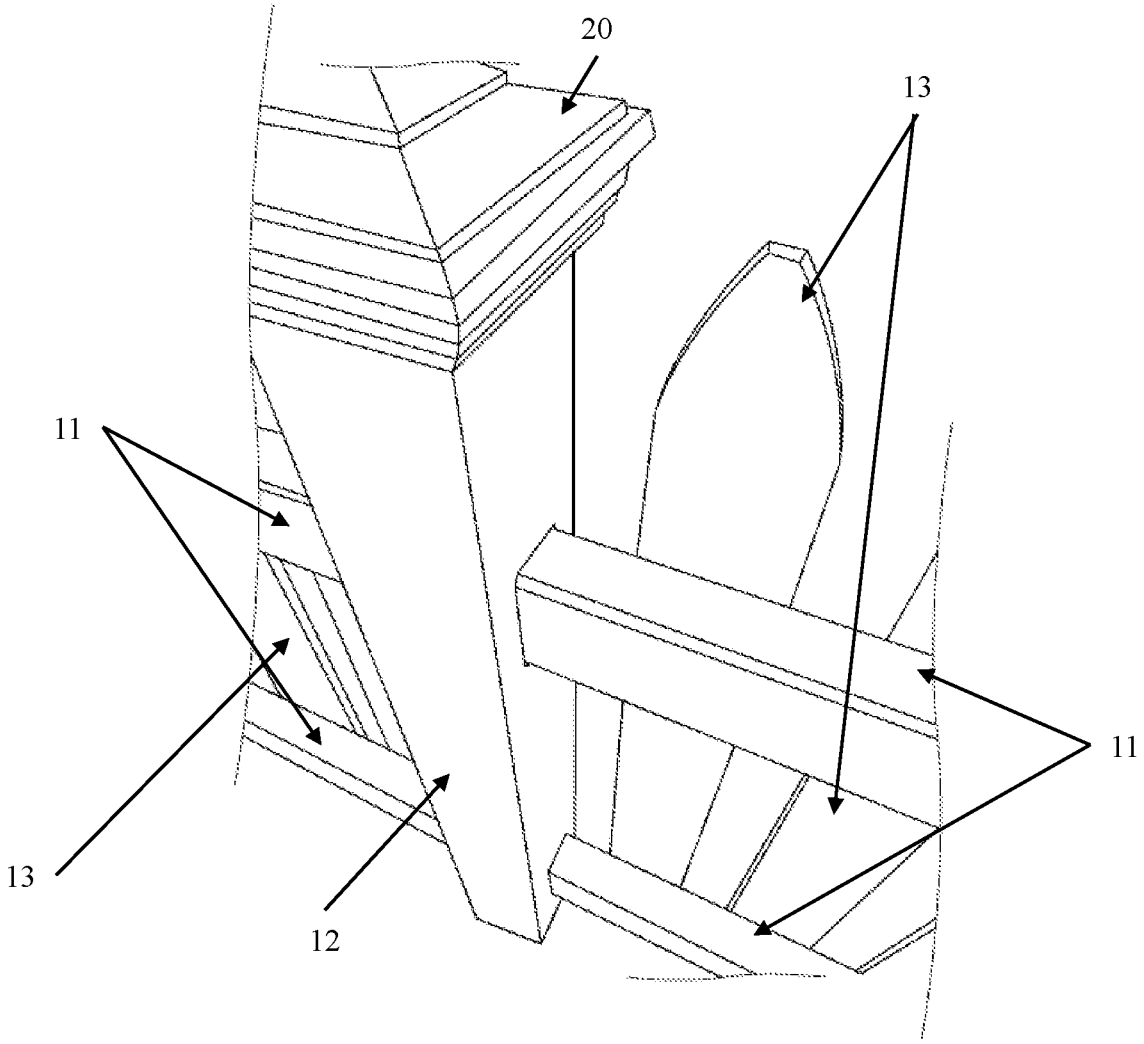

In order to separate or remove horizontal sections 11 and pickets 13, the rail tabs 14 must be depressed to remove the rail 11 from the hole 15 cut into the fence post 12. FIGS. 10-11 are photos of illustrative vinyl fences and the connection means of the posts 12 and rails 11.

Figure 2:
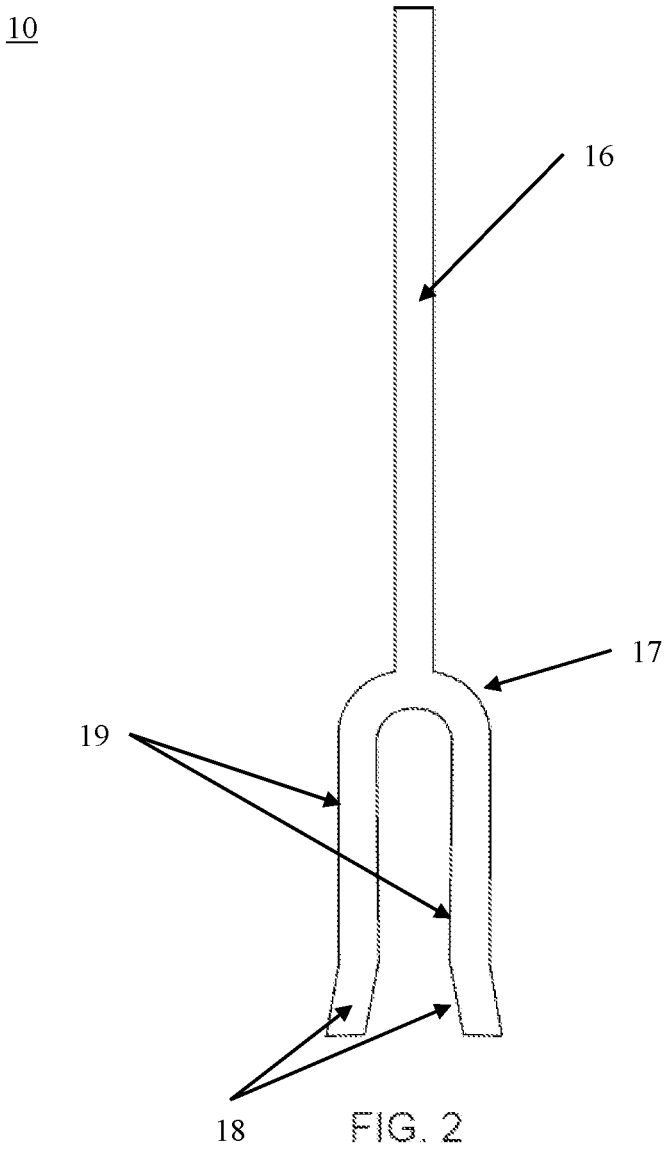
FIG. 2 is front planar view of the device of the present invention.

FIG. 1 is a side perspective view of the fence remover device 10 of the present invention and FIG. 2 is a planar view of the fence remover device 10 present invention. The fence remover device 10 of the present invention has a tube 16 on one end adjacent to a metal "U" shape section 17 which is adjacent to a straight section 19, and the straight section 19 is adjacent to a tapered end 18 one the opposing end of the device from the tube end 16 to slide over fence rail tabs 14. The tube 16 can be as long as necessary to reach s bottom rail 11 through the inside of s fence post 12, typically tube 16 sizes between 3 foot and 6 foot are best.

Figure 3:
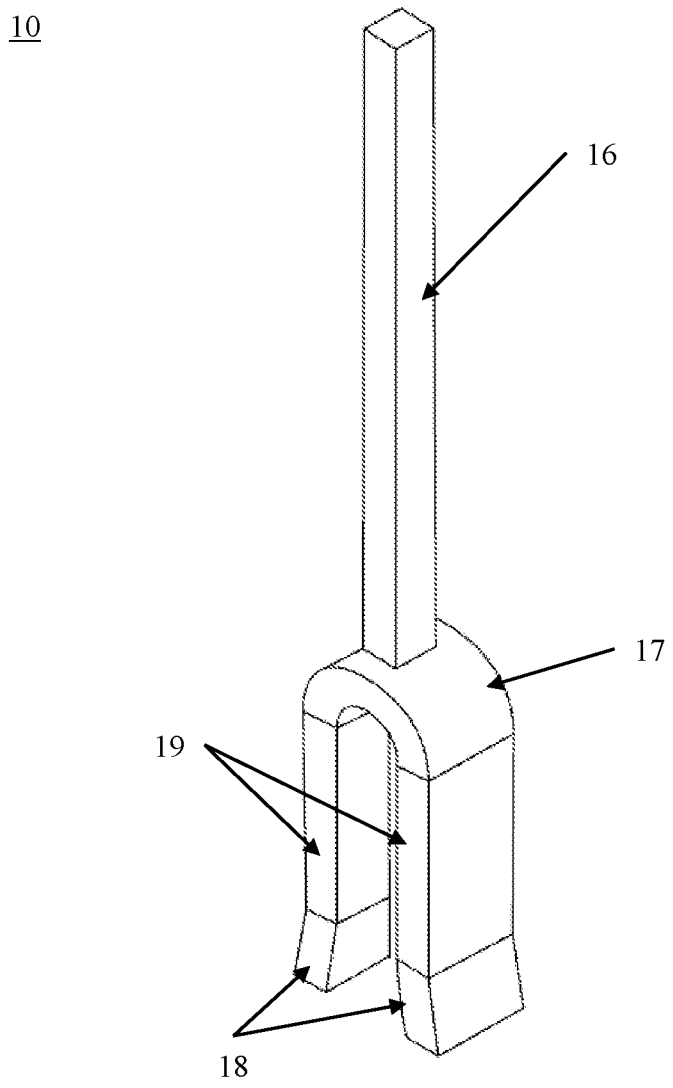
FIG. 3 is a side perspective view of the device of the present invention illustrating the three component parts, the tube, "U"-shaped section, and tapered end.

FIG. 3 is a side perspective view of the fence remover device 10 of the present invention illustrating the four component parts, the tube 16, "U"-shaped section 17, the straight section 19, and tapered end 18. As illustrated in FIG. 3, the "U" shaped piece 17 is the exact size or ⅛ inch to ¼ inch smaller than of the fence rail 11, typically 1.5 to 2 inches wide.

Figure 4:
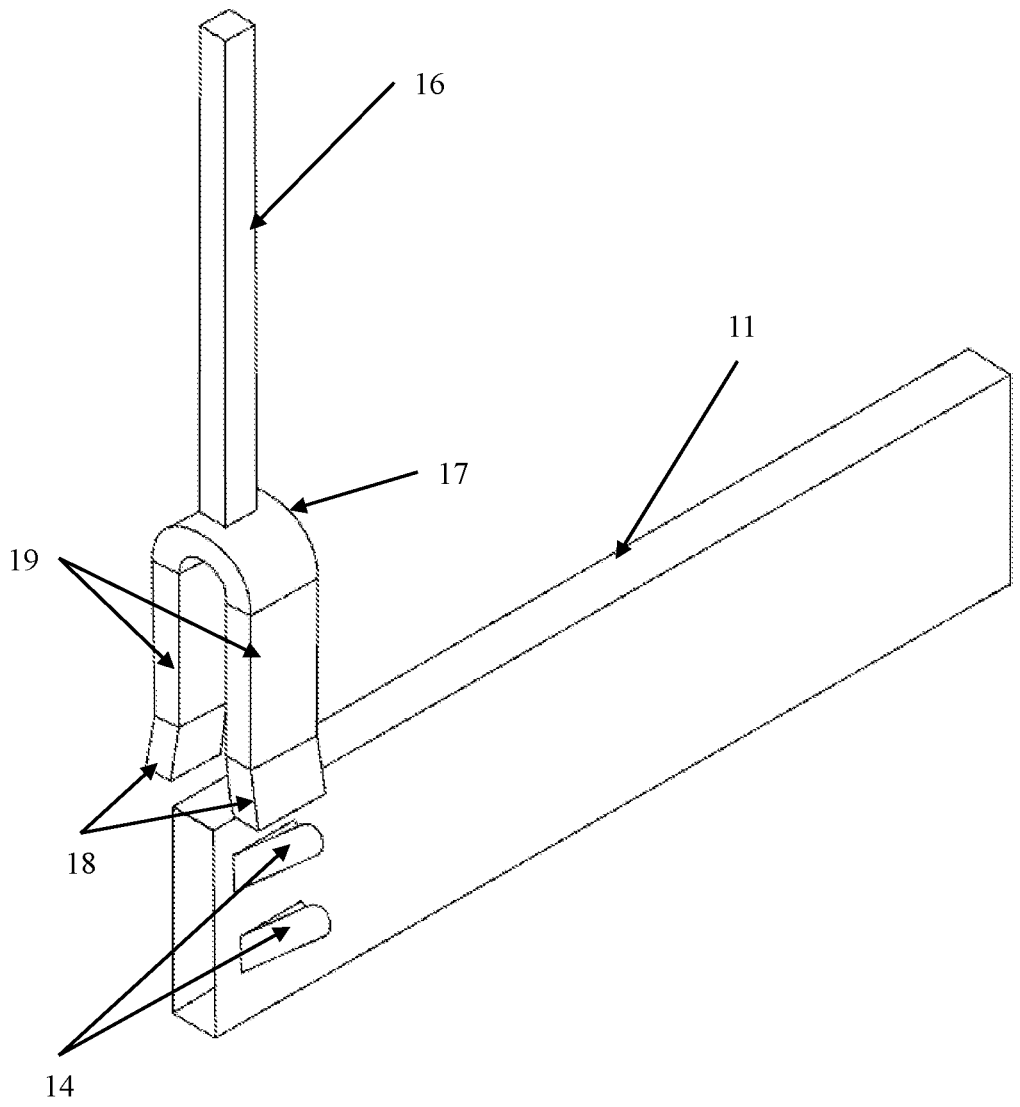
FIG. 4 is a perspective view showing the orientation of the device of the present invention with respect to a fence rail, when being prepared for used in the removal of an installed fence rail.

The open end of the "U" shaped metal section 17 is followed by a straight section 19 that is further comprised of a tapered or bent outward end 18 opposing the tube end 16, which allows the device to slip over the tabs 14 as the fence remover device 10 is driven over the rail 11 inside the fence post 12 as illustrated by FIG. 4.

Figure 5:
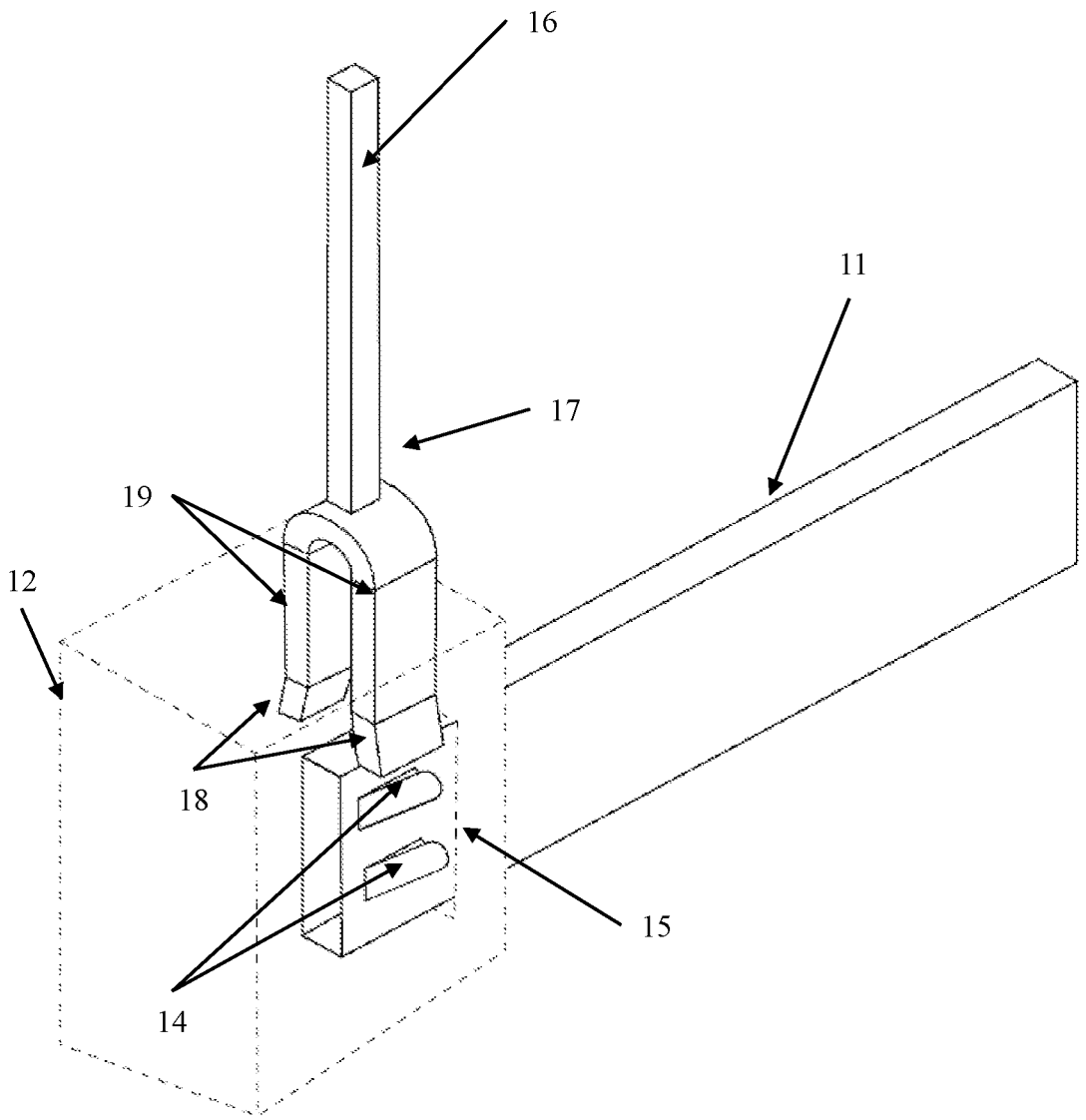
FIG. 5 is a side perspective view of the device of the present invention and a fence rail illustrating the tabs on the fence rail which are used to secure the rail in place upon installation and must be depressed for removal.

Now referring to FIG. 5, fence rail removal tool 10 is operated by removing the fence post cap 20 and pushing the fence rail remover tool 10 over the top fence rail 11, keeping the tabs 14 centered in the "U" shaped section 17. As the fence remover device 10 is pushed over the rail 11 it pushes the tabs 14 in. A first or top rail 11 can then be pulled through the hole 15 in the fence post 12 with no damage to the tabs 14, allowing the rail 11 to be reused. The same procedure can be repeated for as many rails 11 that are in the fence post 12.

Figure 8:
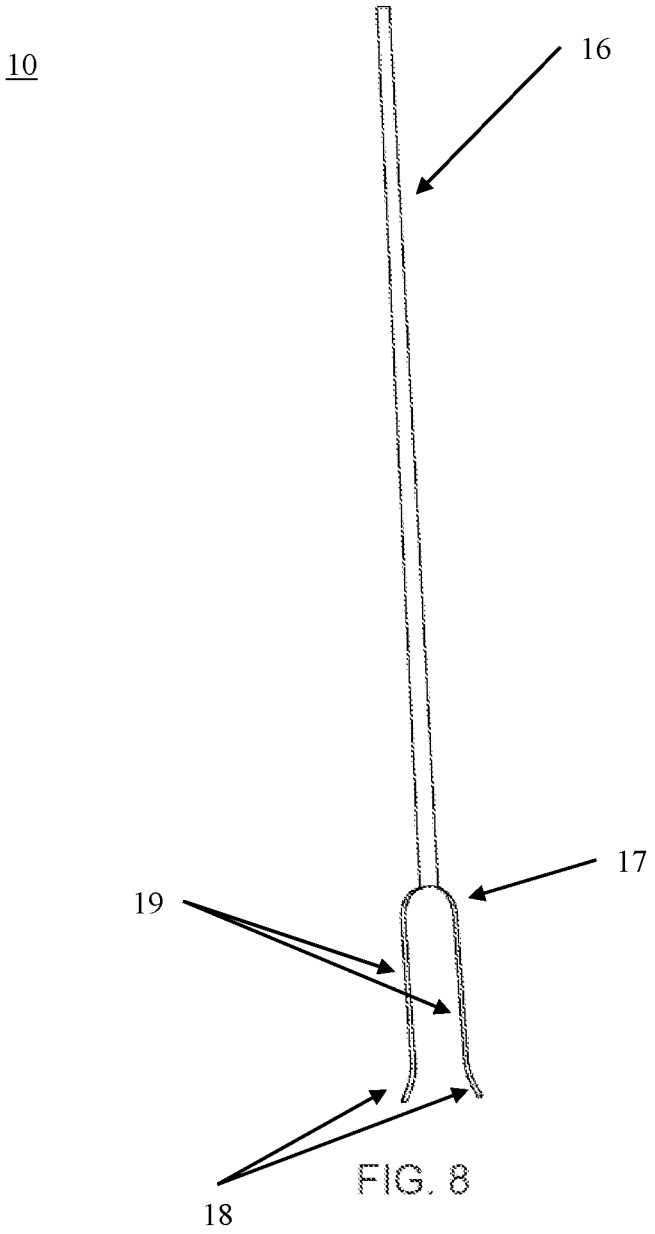
FIG. 8 is a front planer view of a prototype of the device of the present invention.
Figure 9:
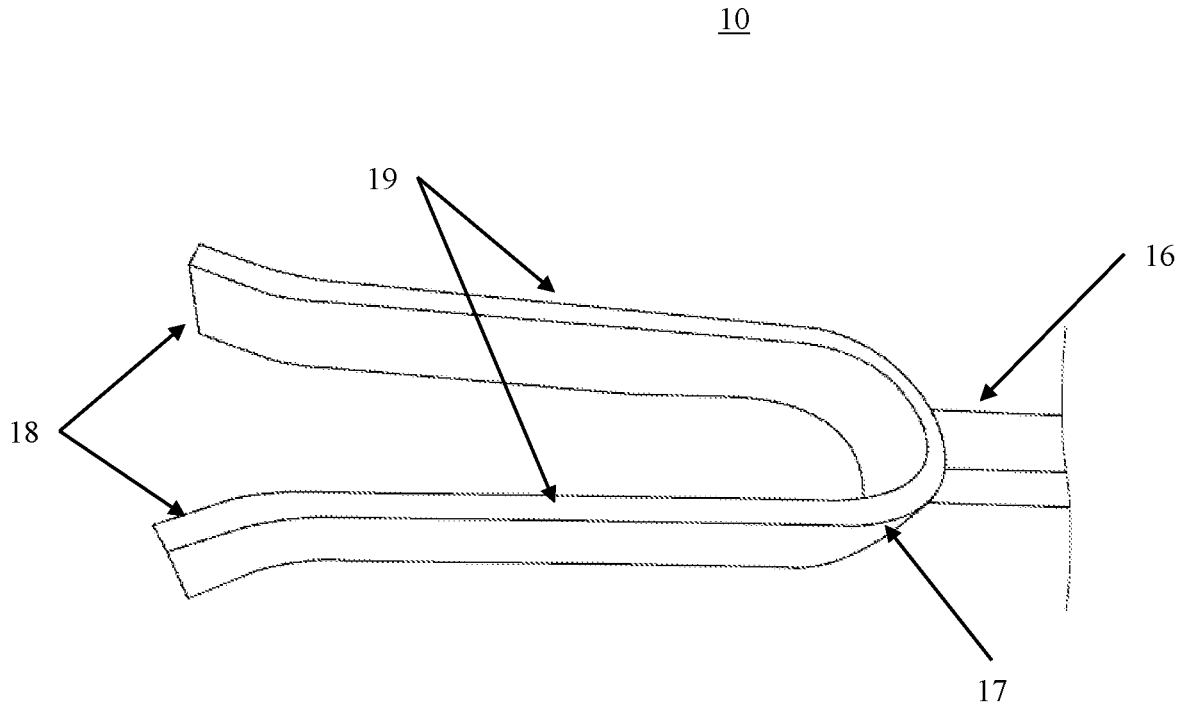
FIG. 9 is side planer view of a prototype of the device of the present invention.

The fence rail fork device 10 of the present invention is a one-piece design. FIG. 8 is a front planer view of a prototype of the fence rail fork device 10 of the present invention. FIG. 9 is side planer view of a prototype of the fence rail fork device 10 of the present invention.

Figure 6:
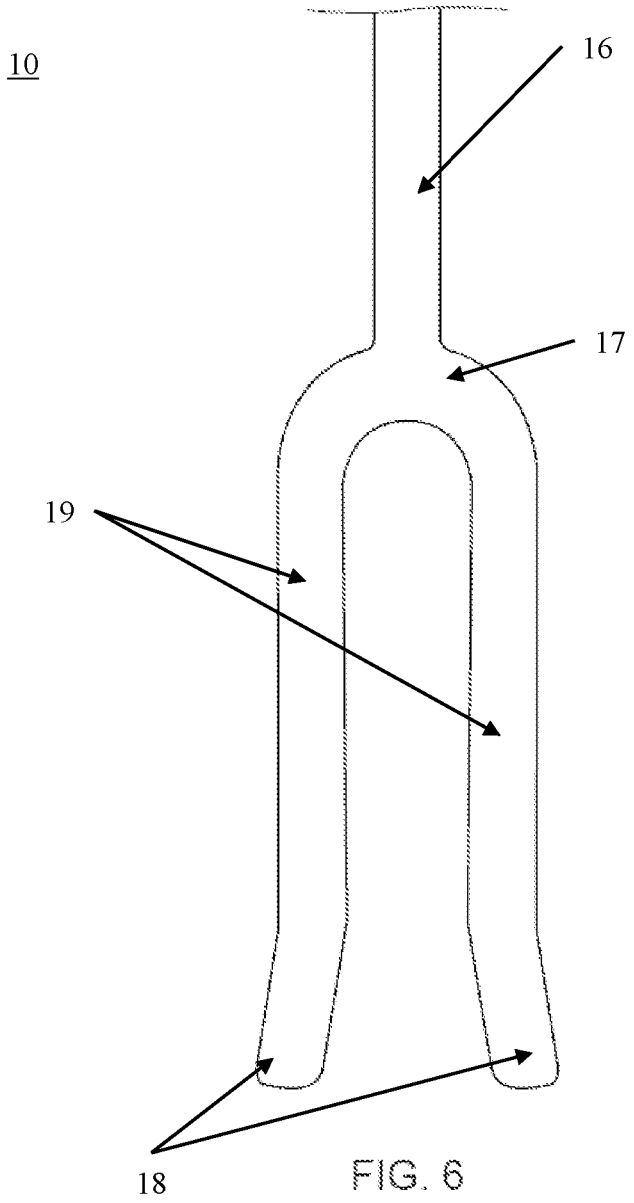
FIG. 6 is a front planer view of the device of the present invention including sizes for each section of a best mode embodiment of the present invention.

FIG. 6 is a front planer view of the fence rail fork device 10 of the present invention including sizes for each section of a best mode embodiment of the present invention. It is illustrated for a best mode embodiment of the present invention, where the handle/tube 16 is 36 inches in length and has a diameter of 0.75 inches. The "U"-shaped section 17 is defined as having an open distance of either 1.5 or 2 inches, the straight section 19 being 5.75 inches long from the inner surface of the U-shaped section 17 to the proximal end of the tapered ends 18, having a thickness of 0.25 inches, and tapered ends 0.75 inches in length comprised of a 20 degree outward taper from proximal to distal end from the centerline of the device defined as the centerline of the tube/handle 16, where the proximal ends of the tapered end 18 are 0.25 inches in width as well, matching the width of the middle "U"-section.

Figure 7:
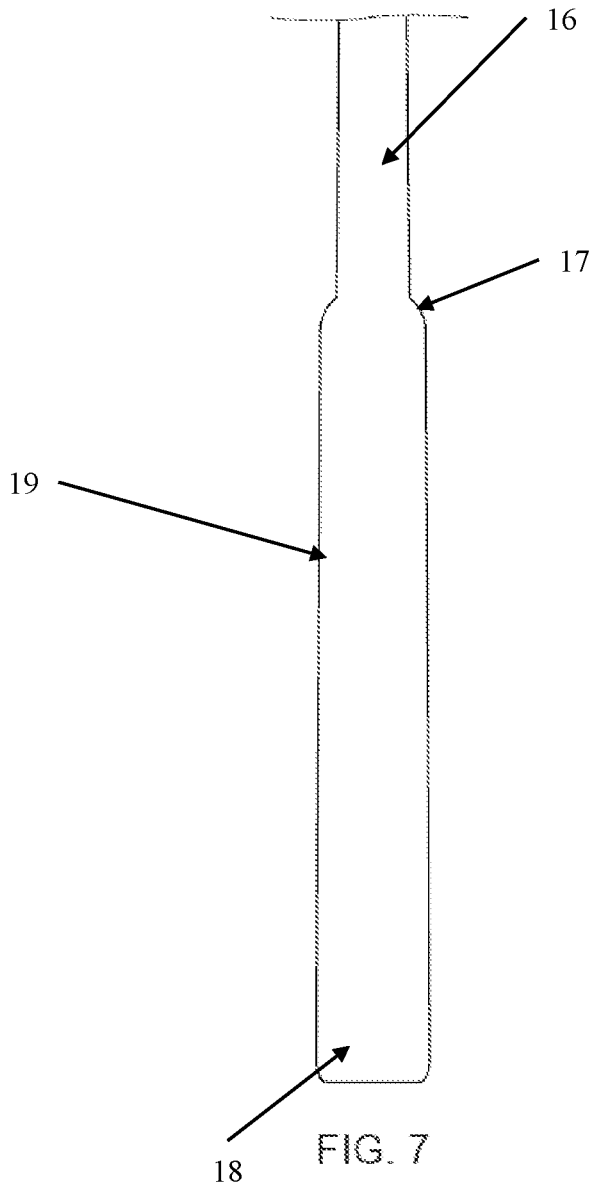
FIG. 7 is a side planer view of the device of the present invention including sizes for each section of a best mode embodiment of the present invention.

FIG. 7 is a side planer view of the fence rail fork device 10 of the present invention including sizes for each section of a best mode embodiment of the present invention. Here the side view illustrates again the handle/tube 16 having a round shape with a 0.75-inch diameter. The width, from the side of the "U"-shaped section 17 and the tapered ends 18 is a uniform 1 inch.

Figure 12:
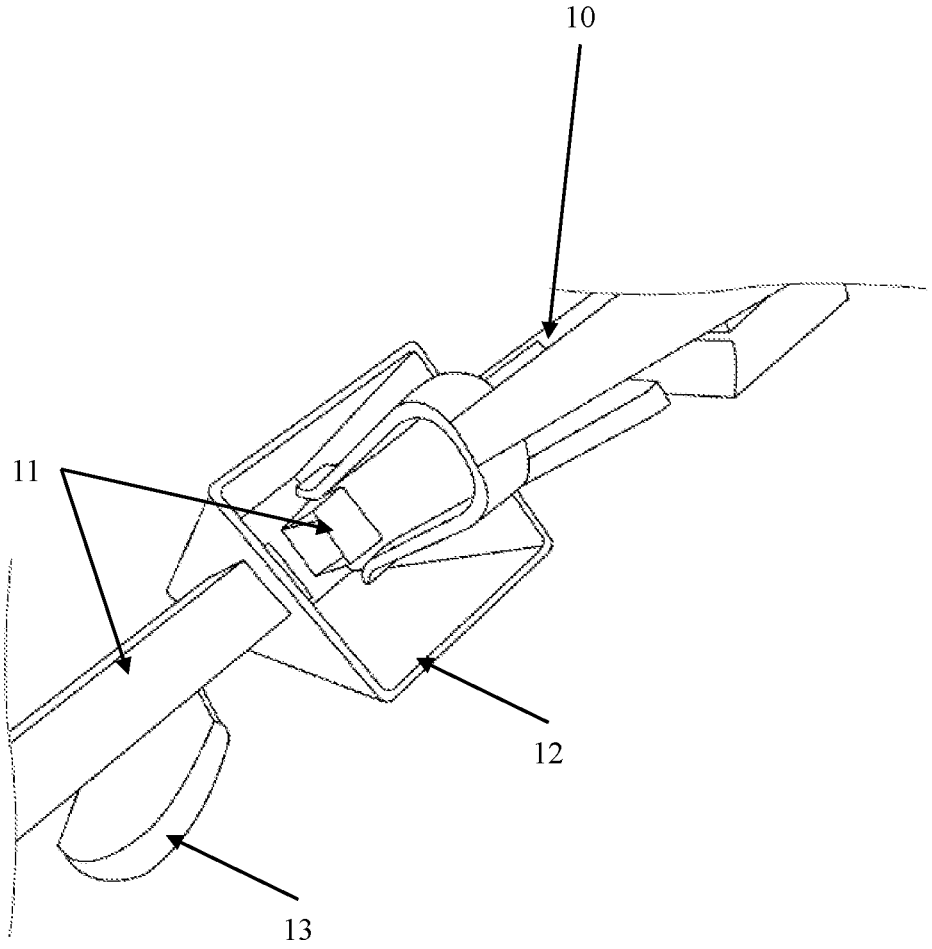
FIG. 12 is a photo illustrating use of the device of the present invention showing where the device is first being inserted over a vinyl fence rail.
Figure 13:
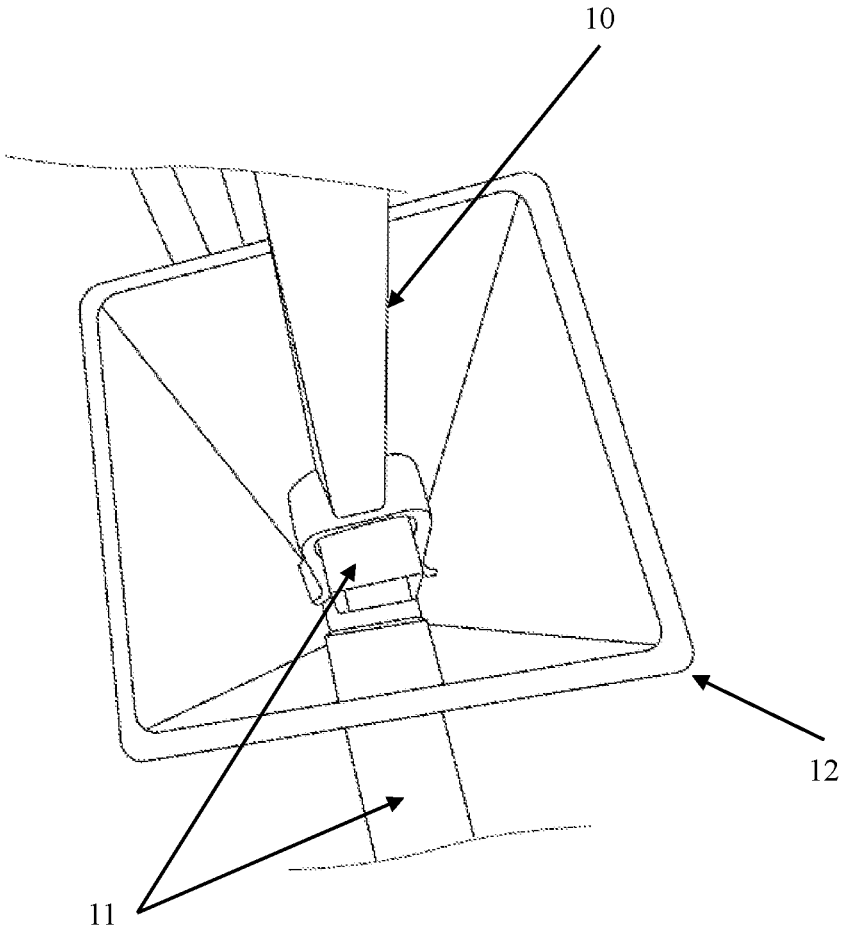
FIG. 13 is a photo illustrating use of the device of the present invention showing where the device is fully inserted over a vinyl fence rail and placing pressure on the tabs allowing release of the rail from the post.

In use, the fence rail fork device 10 is inserted inside the fence post 12 and requires one swill action to push in the tabs 14 on both sides of the rail 11. FIG. 12 illustrates use of the fence rail fork device 10 of the present invention where the fence rail fork device 10 is first being inserted over a vinyl fence rail 11. FIG. 13 illustrates using of the fence rail fork device 10 of the present invention where the fence rail fork device 10 is fully inserted over a vinyl fence rail 11 and placing pressure on the tabs 14 allowing release of the rail 11 from the post 12.

The fence rail fork device 10 works no matter how tight the rail 11 fits into the fence post 12, which is unlike devices currently know in the prior art and offered for sale in the marketplace.

In one exemplary embodiment, a user or worker is required to move one or more sections of vinyl picket fencing. Vinyl rail fencing sections consist of two horizontal rails 11 with pickets 13 connecting the top and bottom rails 11. The rails 11 are rectangular in shape and are inserted into the square holes 15 cut into the fence posts 12. Once inserted. the rails 11 lock in the square hole 15 with tabs 14 that protrude outward on each side of the rail 11 preventing the rail 11 from being removed from the post 12.

In addition to the few prior art devices, there are several home grow methods that state that two putty knives can be inserted next to the rail from outside the fence post through the square hole to push in the tabs in as the rail is pulled out of the post. Unfortunately, this is not true or accurate as the putty knives are non-functional and lead to frustration and often times unavoidable damage. Vinyl fencing rails fit very tight in the square hole and there is little if any room to insert the putty knives on both sides.

There are commercially available tools like those know in the prior art that are intended to more easily accomplish what the putty knife is supported to do, but they are not consistently reliable either because of the limited space between the rail and the square hole in the fence post.

As a result of not being able to get a commercially available or have success with handyman or YOUTUBE type solutions, the inventor tried many alternatives before reaching a viable solution and tool design. First, two wedge shaped pieces of wood driven between the fence rail and the inside wall of the fence post. They were hard to manage, and they tended to push the rail off center making it even harder to pull the rail out.

Next a "U" shaped piece was prototyped by welding two pieces of metal ¼×1.5 inches wide and about 4 inches long on separating piece of steel then welding a tube to the separating piece of steel. This device was then used to push the remover over the rail inside the fence post and the rails were easy to pull through the holes. After conducting more research and doing more development the Inventor realized that no tool like this was available and the existing commercial and prior art tab release tools were only marginally useful, according to several blogs and the inventor's own experience.

As a result of the early prototype success, the inventor continued to refine the tool which, after considerable trial and error as well as research and testing, the inventor constructed something that looks like a tuning fork, as illustrated by the figures, that would fit on both sides of the rail and could push in the tabs from inside of the fence post. This tool consisted of a metal plate welded to the end of the metal rod to form a "U" shaped tool section with tapered ends to allow the tool to self-center on the rail. The tool could be pushed over the rail inside the fence post, pushing in the tabs and allowing the rail to slide through the square hole as illustrated in FIGS. 4-5 and 12-13.

The advantage of the tool of the present invention and the method of its use is that there is no need to have space on both sides of the rail to insert flimsy, flexible, putty knives or metal. The tube or handle section of the present invention is long enough to allow the tool to first extract the top rail to get it out of the way then use the same tool on the bottom rail located further down inside a post to extract it as well.

Although the present invention has been described in considerable detail with reference to certain preferred versions thereof, other versions are possible. Therefore, the point and scope of the appended claims should not be limited to the description of the preferred versions contained herein.

Thus, the device is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

As to a further discussion of the manner of usage and operation of the present invention, the same should be apparent from the above description. Accordingly, no further discussion relating to the manner of usage and operation will be provided.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Furthermore, other areas of art may benefit from this method and adjustments to the design are anticipated. Thus, the scope of the invention should be determined by the appended claims and their legal equivalents, rather than by the examples given.

The embodiments of the invention in which an exclusive property or privilege is claimed are defined as follows:

1. A fencing system comprising:

fencing comprising at least one fence rail and at least one fence post; and a device allowing removal of said fence rail engaged with said fence post comprising: a first end comprising a tube creating a handle section; a middle "U"-shaped section connected the first end; a straight section connected to the "U"-shaped section; a closed end of the "U"-shaped section connected to the first end; an open end of the "U"-shaped section connected to the straight section; the straight section located opposite the closed "U"-shape section; and the straight section connected to a tapered end on each straight section connected to each end of the "U"-shaped section.

2. The system of claim 1, wherein the fencing is vinyl.

3. The system of claim 1, wherein the fencing is comprised of of top and bottom fence rails and pickets, said rails and pickets located between opposing posts to retain the plurality of rails, where the rails are held in the fence post via tabs cut into the rail.

4. The system of claim 3, wherein in order to separate or remove said rails and pickets, the one or more rail tabs must be depressed to remove the rail from a hole cut into the fence post.

5. The system of claim 4, wherein the device is operated by removing a fence post cap and pushing the device over the top fence rail keeping the tabs centered in the "U" shaped section; as the remover is pushed over the rail it pushes the tabs in; and the top rail can then be pulled through the hole in the fence post.

6. The system of claim 5, wherein the procedure as claimed in claim 5 can be repeated for as many rails that are in the fence post.

7. The system of claim 1, wherein the tapered end slides over fence rail tabs on an opposing end from the handle section.

8. The system of claim 1, wherein the handle tube section can be as long as necessary to reach the bottom rail through the inside of a fence post.

9. The system of claim 8, wherein the tube creating a handle section is between 3 foot and 6 foot in length.

10. The system of claim 1, wherein an internal area of the open end of the "U" shaped piece is ⅛ inch to ¼ inch smaller than the exact size of the fence rail.

11. The system of claim 10, wherein an internal area of the open end of the "U" shaped section and straight section connected to the "U" shaped section is 1.5 to 2 inches wide.

12. The system of claim 1, wherein the tapered end is bent outward, which allows the device to slip over the tabs as the device is driven over the rail inside a fence post.

13. The system of claim 12, wherein the tapered ends are 0.75 inches in length comprised of a 20-degree outward taper from the centerline of the device defined as the centerline of the tube/handle.

14. The system of claim 1, wherein the device is a one-piece design.

15. The system of claim 1, wherein the device is inserted inside the fence post and requires one action to push in tabs on both sides of the rail simultaneously.

16. The system of claim 15, wherein the handle section has a square shape with a 0.75-inch diameter; and the width, from the side, of the "U"-shaped section and the tapered ends is a uniform 1 inch.

17. The system of claim 1, wherein the handle section is 36 inches in length and has a diameter of 0.75 inches; the "U"-shaped section is defined as having an open distance of either 1.5 or 2 inches, the straight section being 5.75 inches long from an inner surface of the "U" shaped section to a distant end of the tapered ends, the "U" shaped section and straight section having a thickness of 0.25 inches, and the tapered ends are 0.75 inches in length comprised of a 20-degree outward taper from a centerline of the device defined as the centerline of the handle section; and where ends of the tapered end are 0.25 inches in width, matching the width of the middle U-section.

* * * * *